US006912965B2

(12) United States Patent
Leitch et al.

(10) Patent No.: US 6,912,965 B2
(45) Date of Patent: Jul. 5, 2005

(54) SEMISUBMERSIBLE TRIMARAN

(75) Inventors: John Gaston Leitch, Berkshire (GB); Harvey E. McBee, II, Sugar Land, TX (US); Jan Veldwijk, Sugar Land, TX (US); Douglass John Williams, Houston, TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 10/708,531

(22) Filed: Mar. 10, 2004

(65) Prior Publication Data

US 2005/0115484 A1 Jun. 2, 2005

Related U.S. Application Data

(60) Provisional application No. 60/320,005, filed on Mar. 12, 2003.

(51) Int. Cl.[7] ..... B63B 1/00

(52) U.S. Cl. ..... 114/61.12; 114/261

(58) Field of Search ..... 114/61.1, 61.12, 114/121, 125, 261, 264, 266, 267, 274

(56) References Cited

U.S. PATENT DOCUMENTS

| | | | | | |
|---|---|---|---|---|---|
| 2,405,115 | A | * | 8/1946 | Creed | 114/261 |
| 2,440,345 | A | * | 4/1948 | Neel | 114/261 |
| 3,447,502 | A | * | 6/1969 | Reuven | 114/61.14 |
| 3,556,033 | A | * | 1/1971 | Bonnafous | 114/144 R |
| 3,939,790 | A | | 2/1976 | Varges et al. | 114/260 |
| 4,147,123 | A | | 4/1979 | Kirby et al. | 114/260 |
| 4,556,008 | A | | 12/1985 | Copson | |
| 4,763,596 | A | * | 8/1988 | Yoshida | 114/256 |
| 5,694,878 | A | * | 12/1997 | Masuyama | 114/61.12 |
| 5,823,130 | A | | 10/1998 | Kreyn et al. | 114/61.14 |
| 6,009,820 | A | * | 1/2000 | Kellog et al. | 114/61.1 |
| 6,196,151 | B1 | * | 3/2001 | Grant et al. | 114/266 |
| 6,341,573 | B1 | | 1/2002 | Buck | 114/261 |
| 6,374,764 | B1 | | 4/2002 | Davenport, III et al. | 114/265 |
| 6,378,450 | B1 | | 4/2002 | Begnaud et al. | 114/264 |
| 6,435,123 | B1 | | 8/2002 | .O slashed.deg.ang.rd | |
| 6,532,884 | B2 | | 3/2003 | Profitt et al. | 114/61.12 |
| 6,550,408 | B1 | | 4/2003 | Janssen | 114/121 |

FOREIGN PATENT DOCUMENTS

EP 0 353 829 B1 1/1994

OTHER PUBLICATIONS

Swath International LTD. internet web site; available at http://www.swath.com. Accessed Feb. 18, 2004. Pages last updated Mar. 20, 2002.

"Alstom Has Innovative Spill Clean," Maritime Reporter & Engineering News; Mar. 10, 2003; pp. 38–39.

Alstom Marine, "Alstom Presents the Oil Sea Harvester;" presented at the Offshore Technology Conference, May 2003, Houston, Texas.

* cited by examiner

*Primary Examiner*—Lars A. Olson
(74) *Attorney, Agent, or Firm*—Kellogg Brown & Root, Inc.

(57) ABSTRACT

A semisubmersible trimaran for use in an afloat sea base is disclosed. The trimaran has an upper deck structure 12 supported on a longitudinal center hull 26 and column-stabilized, longitudinal outrigger pontoons 28. The center hull 26 and pontoon columns 38 and 40 have a reduced waterplane area for minimizing motion during operations. The trimaran has a transit draft 37 for deployment at full waterplane area, and an operating draft 36 with a reduced waterplane area for damping motion. The vessel can be deployed with a transit drive 42 on the hull 26, and dynamically positioned at a destination for operations. Multiple trimarans can be assembled to provide an extended upper surface, including a landing area for fixed-wing aircraft.

28 Claims, 9 Drawing Sheets

SEMISUBMERSIBLE TRIMARAN

CROSS REFERENCE TO RELATED APPLICATIONS

This application claims priority to U.S. Provisional Application No. 60/320,005, filed in the United States Patent and Trademark Office on Mar. 12, 2003.

BACKGROUND OF INVENTION

The present invention is directed to a marine platform structure, and particularly to a semisubmersible trimaran with an upper deck supported on a center hull and column-stabilized outrigger pontoons.

It has been proposed to use large marine platform structures as one component in an afloat sea base comprising perhaps a dozen other specialized structures and/or vessels. The marine platform structure would contribute to the capabilities of the afloat sea base in providing logistics and basing functionality, e.g. cargo transfer and warehousing facilities, fuel and water storage, aircraft landing and takeoff facilities, marine vessel and aircraft repair facilities, vehicle storage and repair facilities, personnel housing, hospital, off-shore basing for security operations, and the like.

Such a structure must be deployable to a stationing location at a reasonable transit speed, and yet must be able to stay in position with low motion characteristics in variable wind, wave, and weather conditions. The structure must be stable both during transit and in operation.

Semisubmersible marine structures are well known in the oil and gas industries. Such structures are typically only moveable by towing. These semisubmersibles have a relatively low transit draft that allows them to be floated to a stationing location, where they can add ballast, usually by taking on seawater, to assume a relatively deep draft or semisubmerged condition for operation.

Flotation of semisubmersibles is usually accomplished with pontoons on which an upper deck is supported by columns. The pontoons provide a relatively large waterplane area, as is desirable for transit, but when submerged for stationing, the columns connecting the pontoons to the upper deck present a lower waterplane area for operation. The low waterplane area is desirable to reduce motion characteristics from waves, especially during swell seas and storms. The upper deck from which rig activities are conducted must be maintained above the water plane at all times.

U.S. Pat. No. 5,823,130 to Kreyn et al. discloses a catamaran or trimaran-style vessel for shipping a combination of liquids and containerized cargo. Two or three longitudinal hull sections providing internal tanks for storage of liquids are connected by a deck surface on which to stack cargo containers.

Small waterplane area tri-hull ships or SWATH vessels, have been used as ferries for cars and passengers, cruise vessels, oceanographic research, patrolling, and other off-shore crew service functions. The SWATH acronym has also been applied in trade terminology to twin-hull vessels. Some 50 commercial SWATH vessels have been placed in service worldwide, with displacements typically below 1,000 tons. However, there is a SWATH cruise ship having a displacement of about 11,500 tons.

A SWATH type ship for use in cleaning oil-slicks is currently being developed by Alstom. The trimaran features a large slender central hull, and two lateral stabilizing hulls. Oil is collected from the surface of the water between the hulls, where the area between the hulls is protected from the current allowing stabilization for improved collection. The ship is designed to operate in gale force conditions and can hold up to 6000 metric tons of collected oil.

U.S. Pat. No. 6,550,408 to Janssen discloses methods and apparatus for more economically loading/unloading cargo from a multi-hull ship. Janssen teaches a design of SWATH ships having no interior cargo holds, arid using surfaces of a segmented, submersible platform for stowing floatable cargo.

U.S. Pat. No. 6,378,450 to Begnaud et al. discloses a towed, semi-submersible, twin-hull pontoon structure with four corner caisson columns. The caissons are connected by horizontal braces to reduce spreading and torque-inducing forces. The structure can support an off-shore drilling unit for use in moderate or severe conditions, employing thruster assemblies for dynamic station keeping.

U.S. Pat. No. 6,374,764 to Davenport et al. discloses an apparatus and method for installing a deck on an off-shore substructure, such as for example, a drilling station for oil or gas production. The patent discloses a self-floating apparatus with pontoons which support a self-jacking deck.

U.S. Pat. No. 6,341,573 to Buck provides a ship able to be converted into a floating aircraft runway, supported on slender, buoyant hull/spar legs that pivot downward from a retracted horizontal configuration to a vertical configuration. Multiple vessels are connected together for stationing.

U.S. Pat. No. 3,939,790 to Varges et al. and U.S. Pat. No. 4,147,123 to Kirby et al. disclose flotation methods and monohull ship designs for loading and unloading floatable cargo such as barges.

U.S. Pat. No. 6,532,884 to Profitt et al. discloses designs for various high-speed watercraft, driven by electric motors. The designs generally relate to small craft, such as for example pleasure boats, featuring a submersible center hull and two adjacent, floatable skis on adjustable struts vertically moveable to control the hull submersion.

SUMMARY OF INVENTION

The present invention is a semisubmersible trimaran that can be stable during transit and can have a reduced waterplane area for inhibiting motion during on-station operations. The semisubmersible trimaran has favorable motion characteristics and capability for supporting large payloads. The outrigger characteristics, small waterplane area, and buoyancy characteristics can enhance transit speed. A combination of large payload capacity, enhanced speed characteristics, and basing capability give the semisubmersible trimaran both commercial and tactical advantages over conventional marine platforms and vessels. In particular, the semisubmersible trimaran provides basing capability for relatively larger fixed-wing aircraft for landing/takeoff, storage, and maintenance, e.g. compared to conventional ship-based aircraft.

In one embodiment, the invention provides a semisubmersible trimaran having an upper deck structure supported on a longitudinal center hull and a pair of column-stabilized, longitudinal outrigger pontoons laterally spaced from the center hull on opposite sides thereof. The upper deck structure can have a thickness of at least about 20 meters. The semisubmersible trimaran can include a superstructure and/or a runway on an upper surface of the deck structure. A plurality of the semisubmersible trimarans in an end-to-end assemblage can form an afloat seabase. The trimaaran can also include a ballast control system to adjust a draft of the trimaran between a relatively shallow transit draft and a relatively deep operating draft, and to regulate trim and list of the trimaran.

Desirably, the operating draft can be from about 180 to 220 percent of the transit draft. The center hull can include a full waterplane area of the hull at the transit draft and a reduced waterplane area of the hull at the operating draft. Desirably, the reduced waterplane area of the center hull can be from 40 to 65 percent of the full waterplane area of the hull, a full waterplane area of the outrigger pontoons at the transit draft can be from 3 to 5 times a reduced waterplane area of the outrigger support columns at operating draft, and a total reduced waterplane area of the trimaran at operating draft is from 35 to 60 percent of a total full waterplane area of the trimaran at transit draft.

The outrigger support columns can include columns spaced fore and aft extending upright from the outrigger pontoons to the upper deck structure. The semisubmersible trimaran can include a transit propulsion drive on the center hull selected from propeller screws, thruster pods, and the like, and combinations thereof. A plurality of dynamic positioning drives can be provided on the pontoons, desirably retractable for transit streamlining. The trimaran can also include a marine docking facility on the center hull, or a marine berthing facility adjacent at least one of the pontoons.

The semisubmersible trimaran desirably has an operating displacement from about 120 to 200 percent of a transit displacement, and an available operating deadweight is at least twice an available transit deadweight. The upper deck structure can have a length from about 1.5 to 2.1 times a width thereof, and a length of the center hull can be from about 150 to 200 percent of a length of the outrigger pontoons.

In another embodiment, the invention provides a semisubmersible trimaran having: (a) an upper deck structure supported on a longitudinal center hull and first and a second outrigger pontoons, wherein the outrigger pontoons each depend from a plurality of upright columns and are laterally spaced from the center hull on opposite sides thereof; (b) a ballast control system to adjust a draft and to regulate trim and list of the trimaran; and (c) full and reduced waterplane areas at transit and operating drafts, respectively, of the center hull and the outrigger pontoons and columns, wherein the reduced waterplane area of the center hull comprises from 40 to 65 percent of the full waterplane area of the hull, and the full waterplane area of the outrigger pontoons comprises from 3 to 5 times the reduced waterplane area of the columns.

In another embodiment the invention provides a semisubmersible trimaran including; (a) an upper deck structure supported on a longitudinal center hull; (b) a first longitudinal outrigger pontoon and a second longitudinal outrigger pontoon, said first and second outrigger pontoons laterally spaced from the center hull on opposite sides thereof, wherein the outrigger pontoons are stabilized by a plurality of columns connected to the deck structure; (c) a transit propulsion drive on the center hull selected from propeller screws, thruster pods, and combinations thereof; and (d) a plurality of dynamic positioning drives on the pontoons. The trimaran can include a ballast control system to adjust a draft of the trimaran between a relatively shallow transit draft with a full waterplane area and a relatively deep operating draft with a reduced waterplane area comprising from 35 to 60 percent of the full waterplane area.

Another embodiment of the invention provides a semisubmersible trimaran having: (a) an upper deck structure supported on a longitudinal center hull; (b) a pair of column-stabilized, longitudinal outrigger pontoons laterally spaced from the center hull on opposite sides thereof; (c) a ballast control system to adjust a draft of the trimaran between a relatively shallow transit draft with a full waterplane area and a relatively deep operating draft with a reduced waterplane area comprising from 35 to 60 percent of the full waterplane area; and (d) a marine docking facility below the upper deck structure on the center hull or one of the outrigger pontoons accessible at the operating draft.

A further embodiment of the invention provides a semisubmersible trimaran including: (a) a central hull with a bow, a stern, and side walls providing a series of buoyancy compartments; (b) a deck structure supported on the central hull, said deck structure having fore and aft portions, port and starboard wings, and top and bottom surfaces defining a storage space therebetween; (c) first and second pontoons each connected to the deck structure by a plurality of columns, said first pontoon laterally positioned beneath the port wing, said second pontoon laterally positioned beneath the starboard wing; (d) liquid storage compartments in the central hull and pontoons; and (e) a ballast control system comprising ballast tanks in the hull and pontoons to control a draft of the trimaran between a relatively shallow transit draft and a relatively deep operating draft. The semisubmersible trimaran desirably has a full waterplane area at the transit draft, and a reduced waterplane area at the operating draft that is from 35 to 60 percent of the full waterplane area. The trimaran can also have a runway to launch and land fixed wing aircraft on the upper deck structure. An afloat seabase can be formed from a plurality of the trimarans connected end-to-end to align the runways.

DETAILED DESCRIPTION

Figure 1:
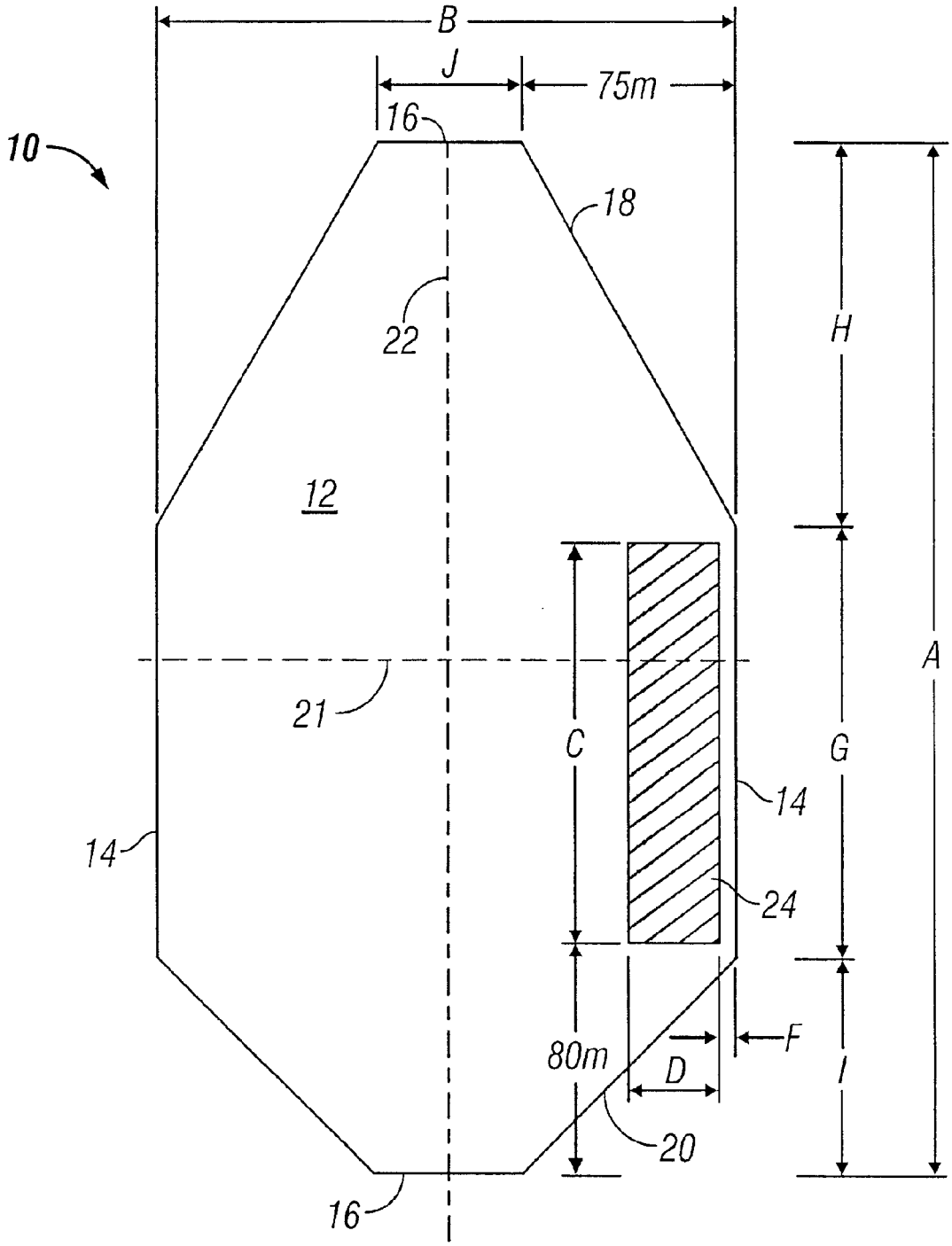
FIG. 1 is a plan view of an upper deck of a semisubmersible trimaran according to an embodiment of the invention.

With reference to the figures, wherein like parts are referred to with like numerals, FIG. 1 shows a semisubmersible trimaran 10 according to one embodiment of the invention. An upper deck structure 12 presents an upper surface with generally straight-sided wings 14 and ends 16, with forward corner section 18 and aft corner section 20, extending therebetween to complete a perimeter. The wings 14 are disposed partially aft of a transverse centerline 21, such that the forward corner sections 18 are more oblique than the aft corner sections 20, relative to a longitudinal axis 22 of the trimaran 10.

The upper surface of the deck 12 can include a longitudinal runway (not shown) at a central area for landing and takeoff of fixed wing aircraft, and a superstructure 24 disposed adjacent to one of the sides or wings 14, e.g. to starboard as shown in FIG. 1. The trimaran 10 can include one or more interior deck sections (not shown), such as for example, a 9-meter upper deck section, two 3.5-meter intermediate deck sections, and a 4-meter lower deck section.

Figure 2:
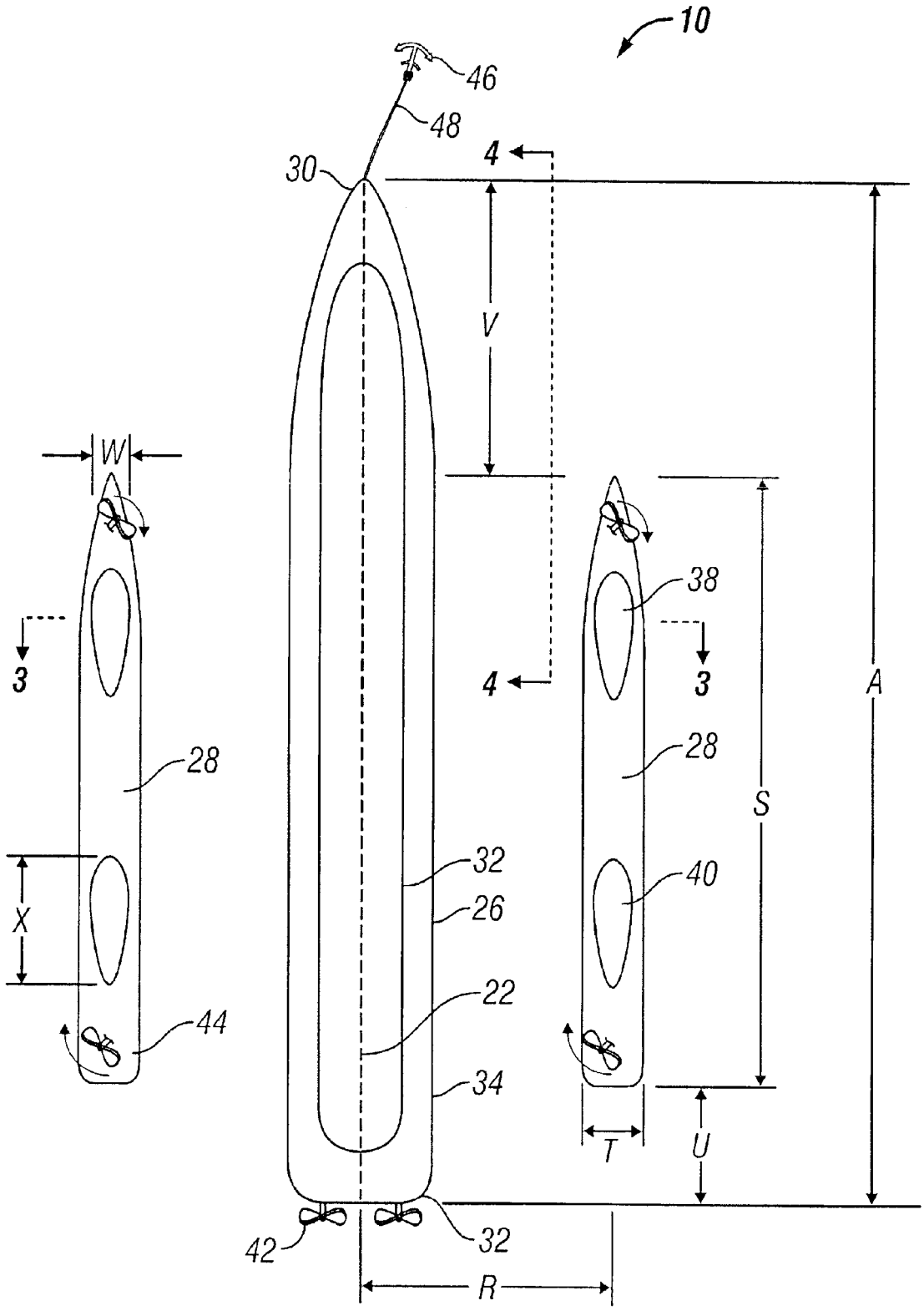
FIG. 2 is a sectional plan view of the center hull and outrigger pontoons of an embodiment of the inventive semisubmersible trimaran of FIG. 1.
Figure 3:
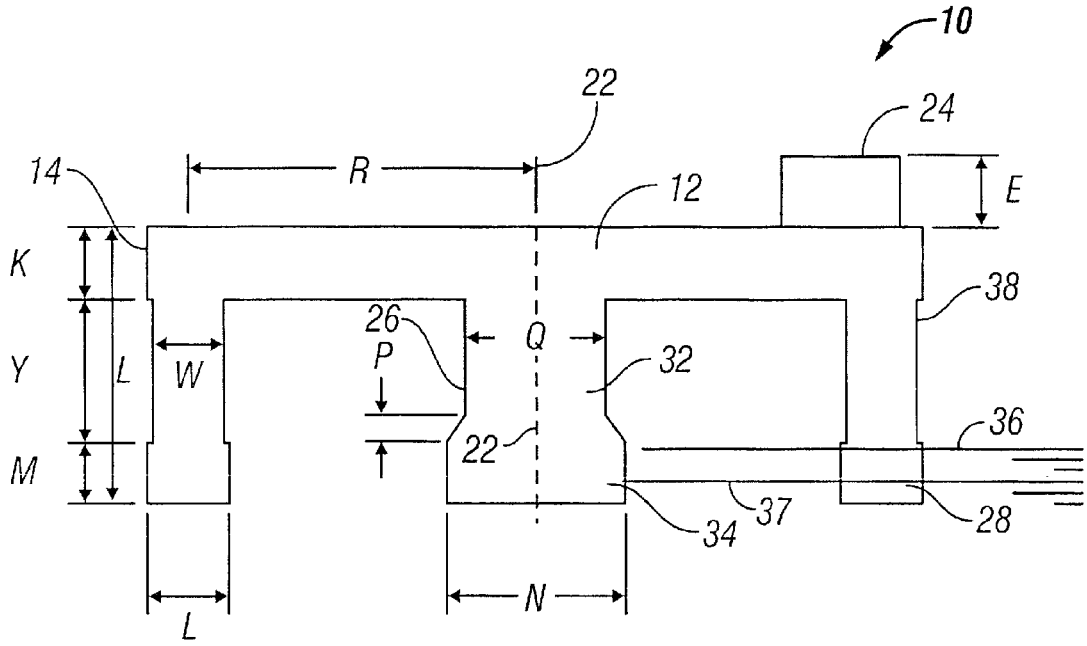
FIG. 3 is a sectional elevation of an embodiment of the semisubmersible trimaran, as seen along line 3—3 of FIG. 2.
Figure 4:
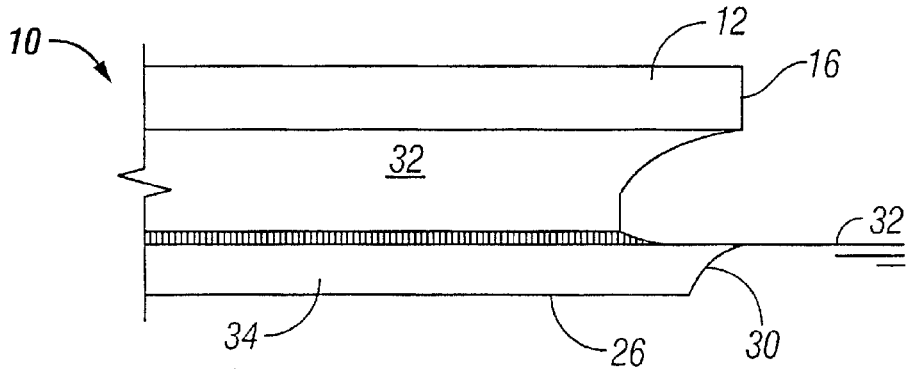
FIG. 4 is an elevation view of the center hull of an embodiment of the trimaran, as seen along line 4—4 of FIG. 2.

With reference to FIGS. 2–4, the deck 12 is supported on a center hull 26 and outrigger pontoons 28. The center hull 26 can run the length of the trimaran 10 from bow 30 to stern 32 adjacent the longitudinal axis 22. The bow 30 can be conventionally streamlined to facilitate reduced resistance and enhanced transit speed. As best seen in FIG. 3, the center hull 26 has a reduced waterplane area in a hull riser section 32 intermediate the deck 12 and a lower hull section 34 of full waterplane area. The hull riser section 32 can have a reduced width and length relative to the lower hull section 34. In transit, running at a relatively shallower draft, a transit water level 37 is at the lower hull section 34 for a larger waterplane area. In on-station operation, with a relatively deeper operating draft, an operating water level 36 can correspond to the reduced waterplane area of the hull riser section 32.

The outrigger pontoons 28 are disposed longitudinally on either side of the center hull 26 and support fore and aft columns 38, 40, respectively, extending from the deck 12 adjacent an outer edge of the wings 14. The columns 38 and 40 present a reduced waterplane area corresponding to the operating water level 36, whereas the pontoons 28 provide a larger, full waterplane area at the transit water level 37. If desired, the pontoons 28 and columns 38 and 40 are shaped to minimize drag or wave resistance, as best shown in FIG. 2.

The center hull 26 can have a length/breadth ratio of from 6 to 9, desirably from 7 to 8, more desirably about 7.4; and a length/depth ratio of from 5 to 9, desirably from 6 to 8, more desirably about 6.9. The pontoons 28 can have a length/breadth ratio of from 8 to 12, desirably from 9 to 11, more desirably about 9.7; and a length/depth ratio of from 10 to 16, desirably from 12 to 14, more desirably about 13.3. An outrigger support column desirably has a length to breadth ratio of from 8 to 12, especially about 9.6.

For transit, one or more screw drives 42 or thruster pods (not shown) are mounted aft on the center hull 26 to deploy the trimaran with conventional propulsion. Dynamic positioning drives 44 are disposed at multiple locations, desirably fore and aft on each pontoon 28, for positioning the trimaran 10 during operations. The dynamic positioning drives 44 can independently rotate 360 degrees in a horizontal plane to provide directional thrust as needed for operational stationing, and are desirably retractable for streamlining during transit. During operation, it is desirable to dynamically maintain a vessel heading such that waves break on the bow 30 or stern 32 and do not broadside the pontoons 28 and center hull 26.

An anchor 46 or other mooring device can be attached via line 48, desirably for single-point mooring, e.g. at the bow 26.

The trimaran 10 assumes various drafts for different purposes, generally controlled by a ballast officer or ballast system controller by taking in or releasing seawater to adjust displacement. For loading or servicing the semisubmersible trimaran 10 on-station or in a port, for example, a minimum draft may be required. Ballast control is also useful to maintain a desired draft when the draft would otherwise change, for example in transfer of cargo (deadweight) to or from the trimaran 10, or to different locations on the trimaran 10. The trimaran 10 is trimmed and leveled by allocating ballast preferentially to port, starboard, fore, aft, etc., as needed, thereby balancing masses of deadweight and loads of the trimaran 10.

At sea during deployment to a station, the transit draft can be maintained, usually with the full waterplane area at the transit water line 37. This posture minimizes drag and maximizes stability, speed, and efficiency in transit. Upon arrival on station, flooding ballast tanks in the center hull 26 and/or pontoons 28, as necessary, achieves a displacement that attains the operating draft. This provides a reduced waterplane area to minimize transient movement from wave action, e.g. heave, roll, and pitch.

Figure 5:
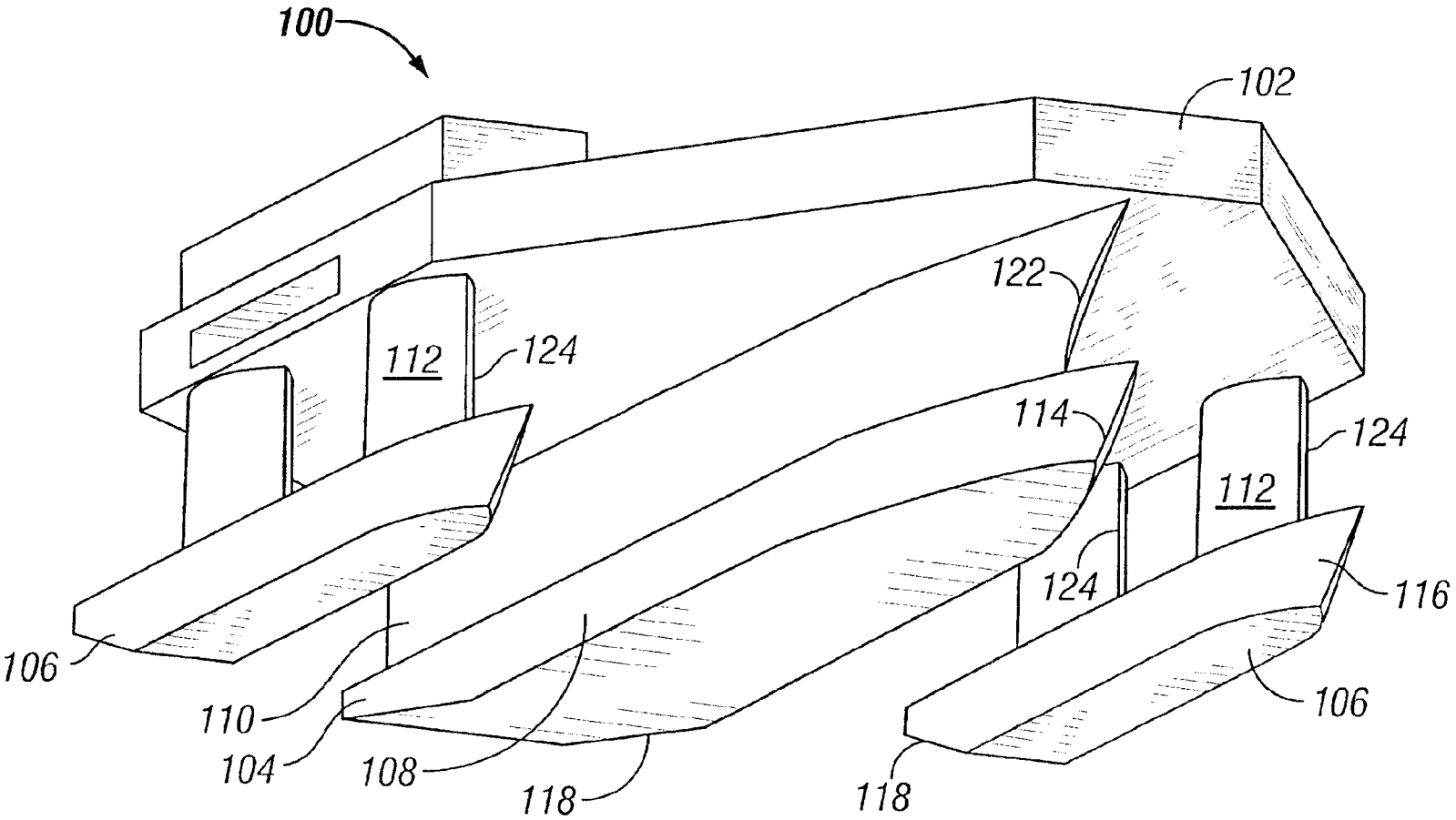
FIG. 5 is a perspective view of a semisubmersible trimaran according to an embodiment of the invention, as seen from below forward starboard.
Figure 6:
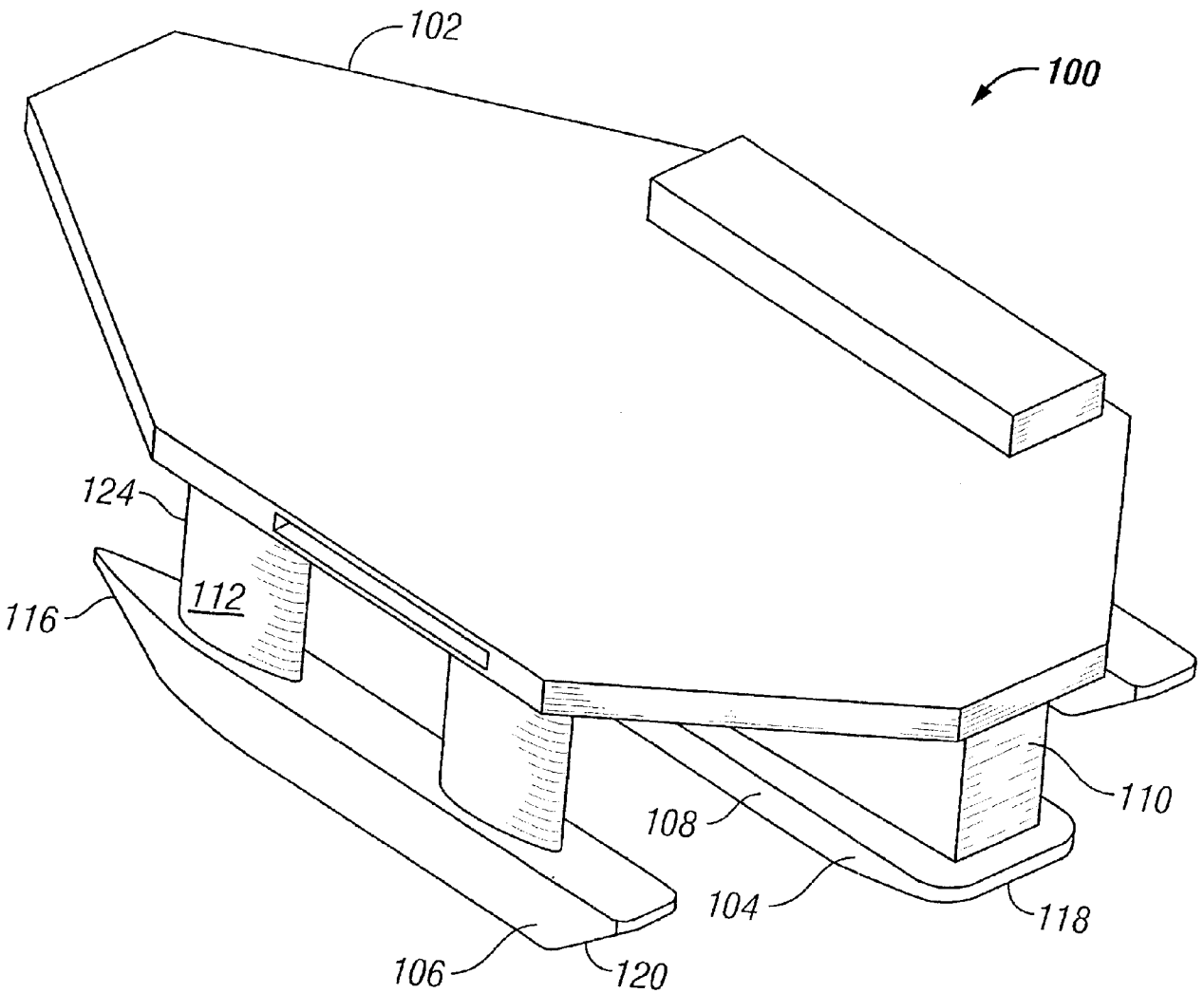
FIG. 6 is a perspective view of the semisubmersible trimaran of FIG. 5, as seen from above aft port.

FIGS. 5–6 show three-dimensional renderings in two perspectives of an embodiment of a semisubmersible trimaran 100 having improved motion characteristics. The upper deck structure 102 is supported on the center hull 104 and outrigger pontoons 106. The center hull 104 includes the full hull section 108 supporting the riser section 110 of reduced length and width, relative to the full hull section 108, to reduce the waterplane area at operating draft. The pontoons 106 support deck 102 and are attached via columns 112. The columns 112 also present a reduced waterplane area at the operating draft.

The center hull 104 and pontoons 106 have bows 114 and 116, respectively for reduced drag, and bottom-sloped keels 118 and 120, respectively. The riser section 110 can also have leading profiles or bows 122 shaped for reduced wave resistance. Similarly columns 112 can have leading profiles or bows 124 shaped for reduced wave resistance.

Figure 7:
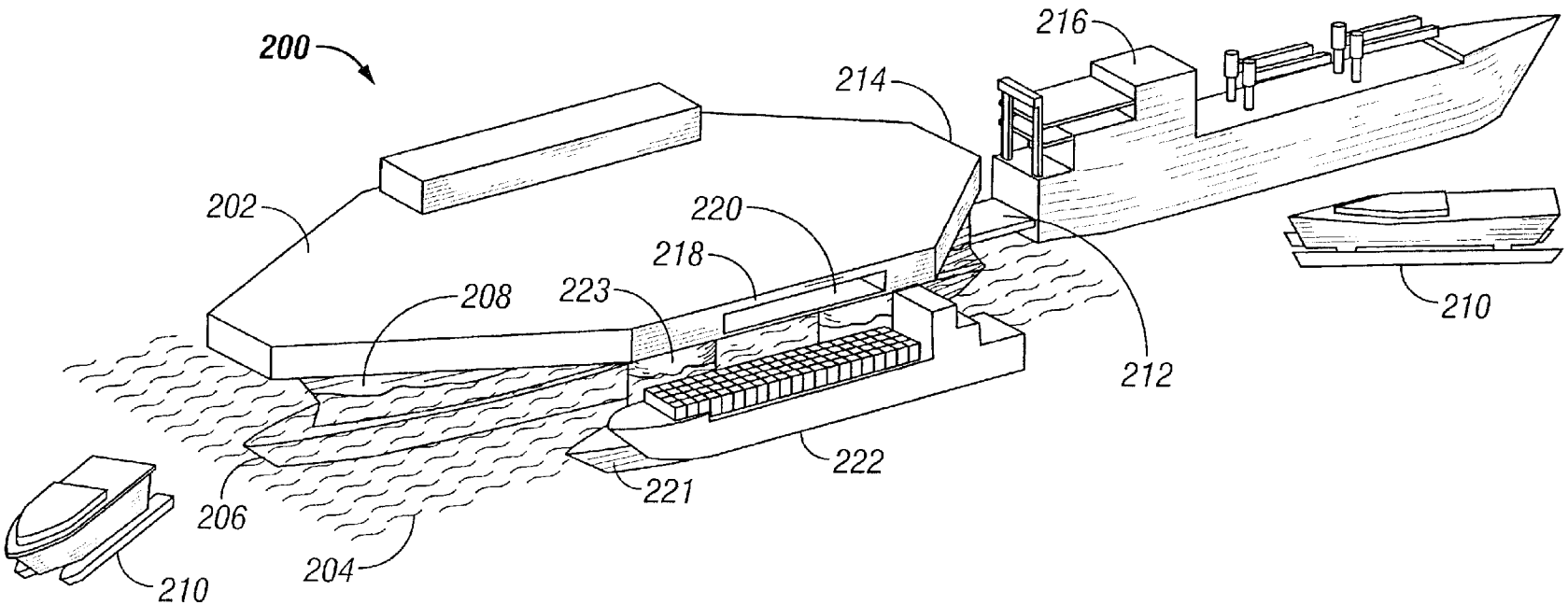
FIG. 7 is a perspective view of an embodiment of the semisubmersible trimaran of FIGS. 5–6 from above forward port, showing vessels berthing for loading and unloading.
Figure 8:
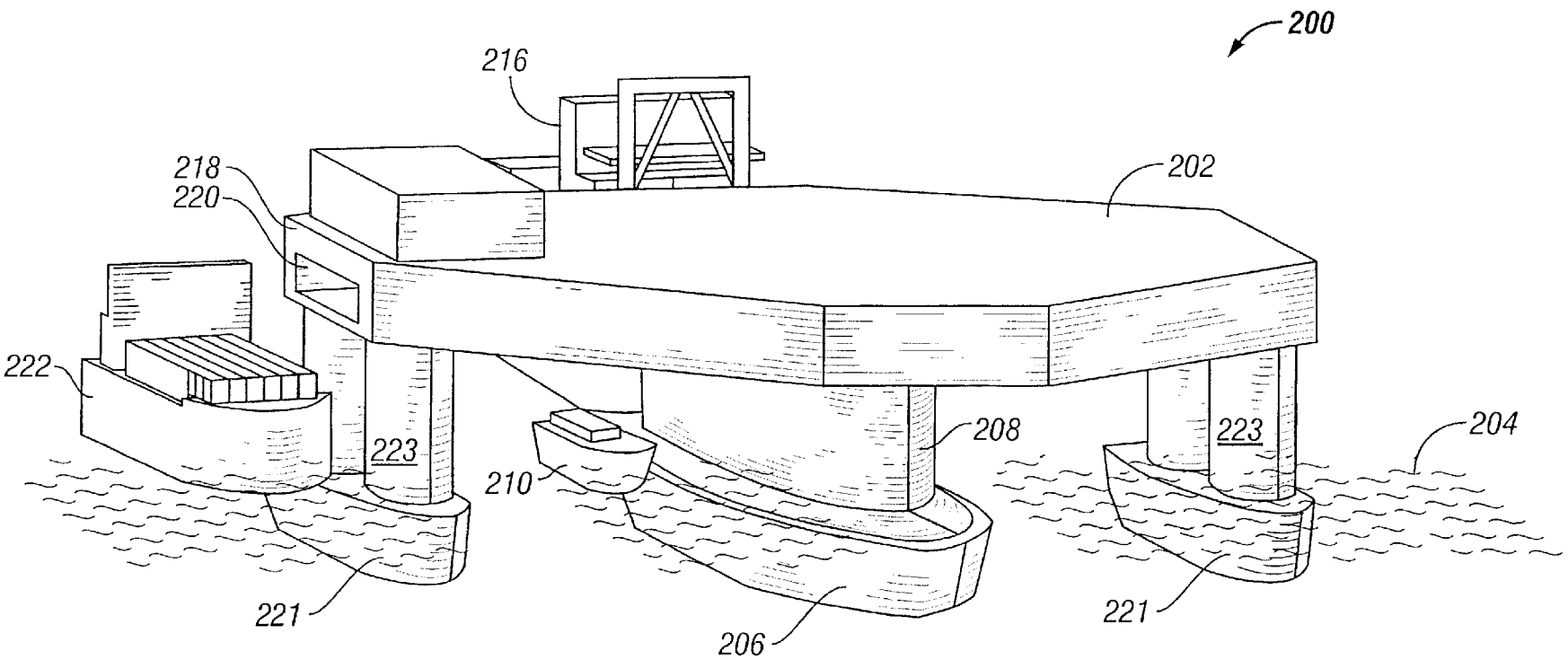
FIG. 8 is a perspective view of an alternative embodiment of the semisubmersible trimaran of FIG. 7, viewed from above forward starboard.

FIGS. 7–8 show a semisubmersible trimaran 200 in two cargo transfer embodiments. The deck structure 202 provides berthing access for multiple vessels simultaneously. The operating waterline 204 is desirably above the full section of the center hull 206, at the hull riser 208. It is desirable that the waterline is maintained at a level sufficiently beneath the deck structure 202 to allow vessels, such as, for example, boats 210 to dock alongside the hull riser 208 for personnel or cargo transfer. If desired, a floodable deck (not shown) can be provided in the center hull riser 208, for example, to facilitate transfer of floating cargo to/from onboard stowage, or to dry-dock marine vessels for maintenance.

A roll-on, roll-off (RORO) transfer gangway 212 for motor vehicles and wheeled cargo can be provided, for example, at the stern 214 of the trimaran 200, which is adapted for docking with a RORO vessel 216. Containerized cargo transfer capability (lift-on/lift-off or LOLO) can be provided, for example, on at least one long side 218 of the upper deck structure 202. The LOLO capability desirably includes a cargo bay 220 and crane hoists (not shown) for unloading a LOLO vessel 222 docked abreast the outrigger pontoons 221 and columns 223 of the trimaran 200.

Figure 9:
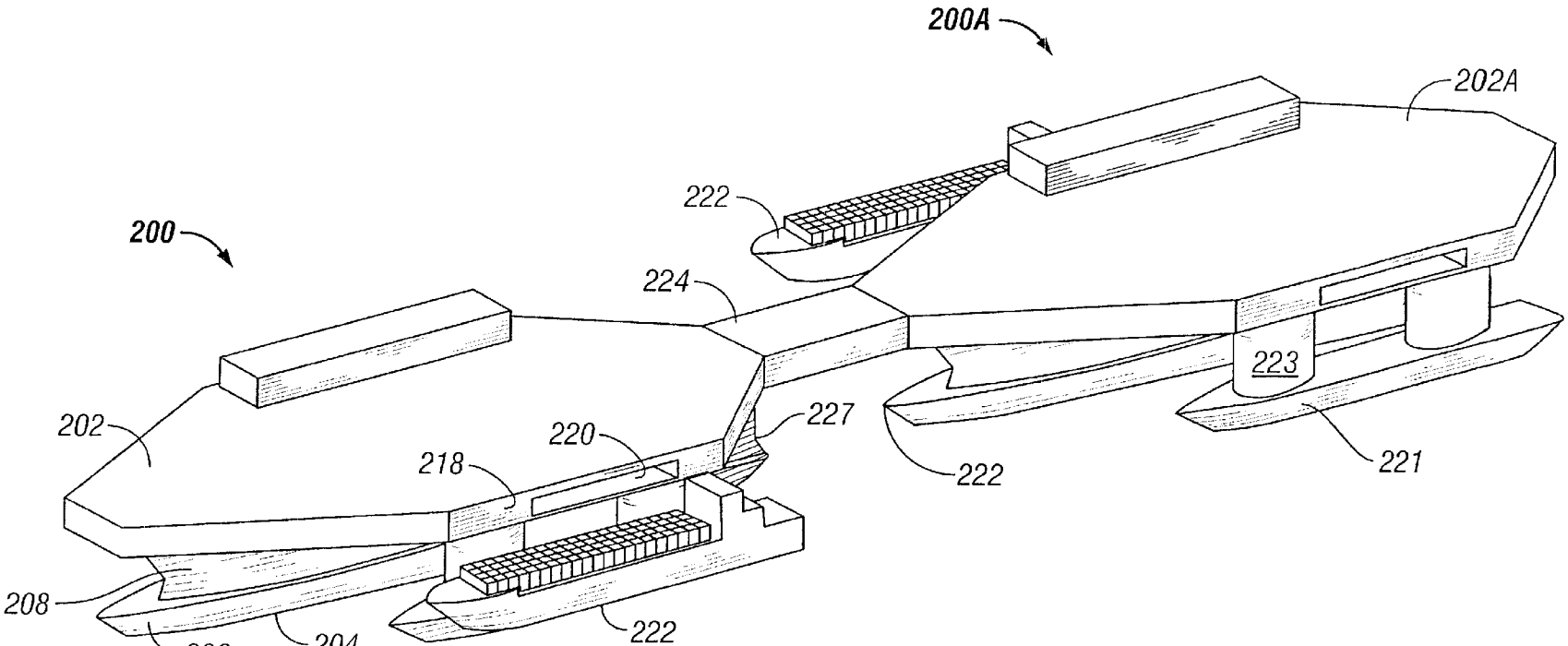
FIG. 9 is a perspective view of an embodiment of the invention showing two semisubmersible trimarans docked together bow-to-stern to form an extended surface.
Figure 10:
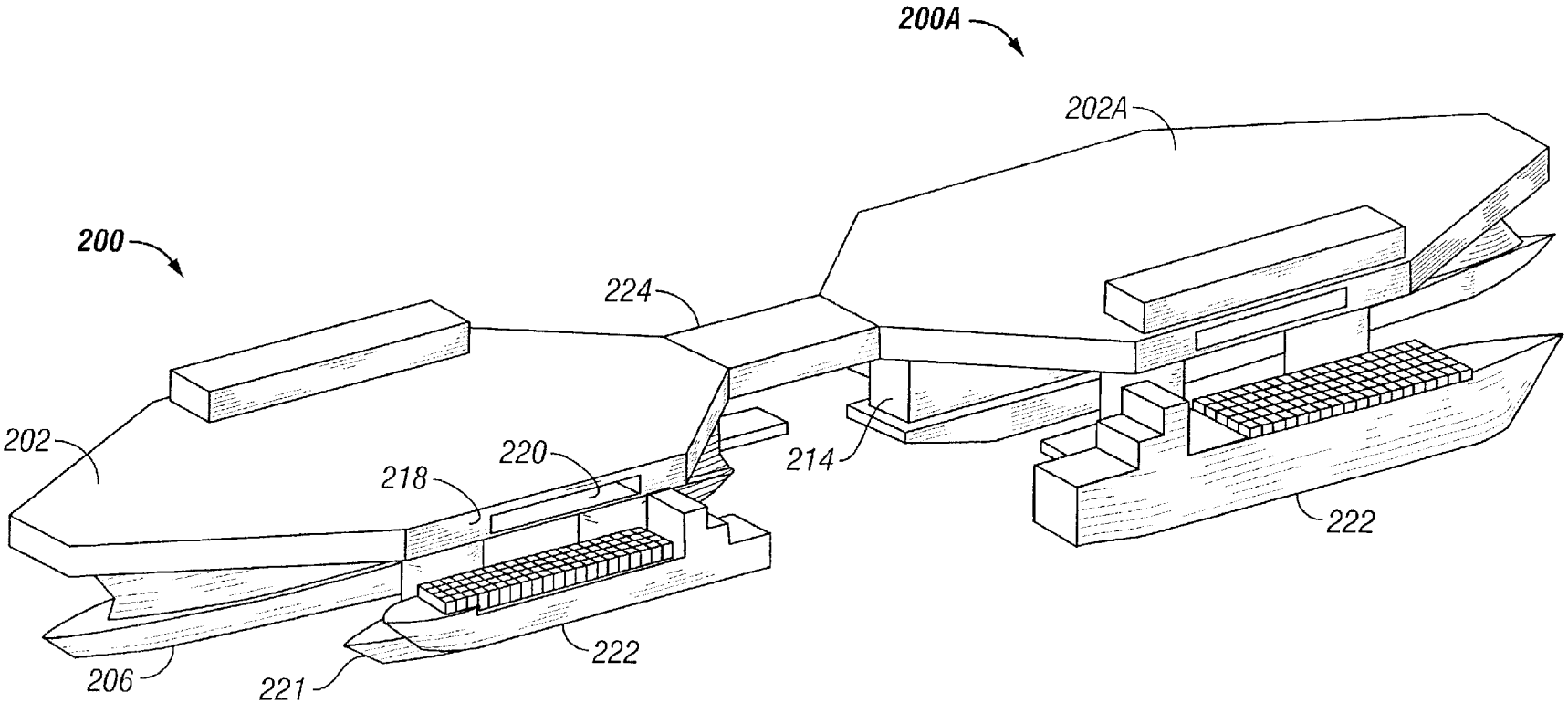
FIG. 10 is a perspective view of an embodiment of the invention showing two semisubmersible trimarans docked together stern-to-stern to form an extended surface.

If desired, a plurality of the semisubmersible trimarans 200 can be joined together in end-to-end embodiments, e.g. bow-to-stern 222/227 as in FIG. 9, stern-to-stern 227/227 as in FIG. 10, or bow-to-bow (not shown). The bow-to-bow embodiment has the benefit of allowing the concurrent conduct of RORO or other aft cargo transfer operation for the end-connected trimarans 200. A connecting gangway 224 joins deck surfaces 202 and 202A to provide a continuous, extended upper deck surface. In joining two or more trimarans, shown in FIG. 9 and 10 as 200 and 200A, sufficient deck surface is provided for landing aircraft, such as, for example, fixed wing aircraft and vertical-takeoff-and-landing (VTOL) craft (not shown).

According to one example of an embodiment of the invention, a semisubmersible trimaran substantially as shown in FIGS. 1–4 has the following approximate dimensions A through Y:

TABLE 1

Example Semisubmersible Trimaran Dimensions.

| Feature | Reference in FIGS. 1–4 | Length (m) |
|---|---|---|
| Overall length (deck/center bull) | A | 360 |
| Overall width | B | 200 |
| Superstructure length | C | 140 |
| Superstructure width | D | 30 |
| Superstructure height | E | 15 |
| Superstructure offset from edge of deck | F | 5 |
| Wing length | G | 150 |
| Wing offset from bow | H | 135 |
| Wing offset from stern | I | 75 |
| Deck width at bow | J | 50 |
| Deck thickness | K | 20 |
| Outrigger/center hull and deck overall height | L | 62 |
| Pontoon/center hull main section height | M | 16 |
| Center hull main section width | N | 50 |
| Center hull transition height | P | 6 |
| Center hull riser width | Q | 37 |
| Outrigger centerline-centerline offset from central hull | R | 90 |
| Outrigger length | S | 215 |
| Outrigger width | T | 22 |
| Outrigger offset from stern | U | 45 |
| Outrigger offset from bow | V | 100 |
| Column width | W | 18 |
| Column Length | X | 45 |
| Column height | Y | 36 |

At a transit draft of 14 m, the trimaran, having the approximate dimensions noted above, has a transit displacement of about 317,684 metric tons (mt) comprising available deadweight of about 106,851 mt. At a draft of 27 m, operating displacement is about 517,618 mt comprising available deadweight of about 306,785 mt. In the operating condition, the semisubmersible trimaran of this example has a metacentric height of 35.5 m, a keel to buoyancy center distance of 12.5 m, and a metacentric center of gravity of 11.8 m, indicating that the vessel is stable. In the transit condition, the semisubmersible trimaran has a metacentric height of 219.4 m, a keel-to-buoyancy-center distance of 8.0 m, and a metacentric center of gravity of 189.8 m.

Fluid storage volume in the pontoons and columns is approximately 153,889 cubic meters ($m^3$) total volume at a permeability of 0.85, where "permeability" is a characteristic of physical area or volume defining usability thereof. Hence, there is a net usable fluid storage volume in the pontoons and columns of approximately 130,806 $m^3$. Storage volume in the center hull is approximately 307,871 $m^3$ total volume at a permeability of 0.3, yielding a net useable volume of approximately 92,361 $m^3$. The total net fluid useable storage volume in the trimaran structure is thus approximately 223,167 $m^3$.

Container storage area is approximately 17,556 $m^2$ total in the center section of the deck structure with a permeability of 0.1, for a net useable area of approximately 1756 $m^2$; container storage area for each of the wing sections is approximately 11,472 $m^2$ with a permeability of 0.9 for a net useable area of approximately 10,325 $m^2$ in each wing section. The total net useable container storage area is thus approximately 22,406 $m^2$. The RORO storage area for rolling vehicles is approximately 8823 $m^2$ in each of three decks in the center hull, with respective permeabilities of 0.6, 0.7, and 0.8, for net useable center-deck RORO storage areas of approximately 5294, 6176, and 7058 $m^2$, respectively. There are approximately 2823 and 4990 $m^2$ in each of the fore and aft upper deck quarters, respectively, with permeability of 0.9, yielding net useable areas of approximately 2541 and 4491 $m^2$. The overall RORO net useable storage area is thus approximately 32,593 $m^2$ or, at 45 $m^2$/vehicle, space for approximately 724 vehicles.

Referring to Tables 2 through 6 below, Table 2 provides non-limiting details for a trimaran according to the example. Volumes, capacities, and lightship weights of the upper deck structure for the example are shown in Table 3. Table 4 provides volumes, capacities, and lightship weights of the center hull for the example. Table 5 provides volumes, capacities and lightship weights of the outrigger pontoons for the example. Table 6 provides capacities and deadweights for fluid and cargo at transit and operating drafts for the example.

Nomenclature in Tables 2–6 includes the following: LS=lightship; OWL=operating waterline; P=port; PA=port aft; PF=port forward; S=starboard; SF=starboard forward; SA=starboard aft; WL=waterline. In Table 6, the unit weight for "crew and provisions" is in metric tons per person.

TABLE 2

Example Semisubmersible Trimaran General Attributes.

| Specification | Value |
|---|---|
| Overall length, m | 360 |
| Overall breadth, m | 200 |
| Transit draft, m | 14 |
| Operating draft, m | 27 |
| Lightship weight, mt | 213,000 |
| Transit displacement, mt | 335,000 |
| Available transit deadweight, mt | 122,000 |
| Operating displacement, mt | 534,000 |
| Available operating deadweight, mt | 322,000 |
| Work deck area, $m^2$ | 52,000 |
| Container storage space (9 m high), $m^2$ | 22,000 |
| (containers) | (2725) |
| Vehicle storage space (9–12 in high), $m^2$ | 33,000 |
| (vehicles) | (724) |
| Hanger space (9 m high), $m^2$ | 14,000 |
| Other floor space in upper deck structure, $m^2$ | 112,000 |
| Superstructure floor space, $m^2$ | 21,000 |
| Fluid storage volume, $m^3$ | 223,000 |

TABLE 3

Example Semisubmersible Trimaran Upper Deck Structure.

| Block | Shape factor | Length (m) | Width (m) | Depth (m) | Area ($m^2$) | Volume ($m^3$) | LS Coeff. | LS Wt (mt) |
|---|---|---|---|---|---|---|---|---|
| Center | 1 | 360 | 48.8 | 18.3 | 17,556 | 321,042 | 0.11 | 35,315 |
| P wing | 1 | 152.4 | 75.3 | 18.3 | 11,472 | 209,797 | 0.11 | 23,078 |
| S wing | 1 | 152.4 | 75.3 | 18.3 | 11,472 | 209,797 | 0.11 | 23,078 |
| PF qtr | 0.5 | 132.6 | 75.3 | 18.3 | 4,990 | 91,262 | 0.11 | 10,039 |
| SF qtr | 0.5 | 132.6 | 75.3 | 18.3 | 4,990 | 91,262 | 0.11 | 10,039 |
| PA qtr | 0.5 | 75 | 75.3 | 18.3 | 2,823 | 51,626 | 0.11 | 5,679 |
| SA qtr | 0.5 | 75 | 75.3 | 18.3 | 2,823 | 51,626 | 0.11 | 5,679 |
| Super-structure | 1 | 140.2 | 30.5 | 15.2 | 4,273 | 65,119 | 0.08 | 5,210 |
| TOTAL | | | | | 60,399 | 1,091,531 | | 118,117 |

TABLE 4

Example Semisubmersible Trimaran Center Hull.

| Block | Shape factor | Length (m) | Width (m) | Depth (m) | Area ($m^2$) | Volume ($m^3$) | LS Coeff. | LS Wt (mt) |
|---|---|---|---|---|---|---|---|---|
| Above WL | 0.904 | 320 | 30.5 | 25 | 8,823 | 220,576 | 0.11 | 24,263 |
| Chine to WL | 0.904 | 320 | 30.5 | 4.9 | 8,823 | 43,233 | 0.11 | 4,756 |
| Chine | 1 | 324.6 | 39.7 | 6.1 | 12,870 | 78,454 | 0.12 | 9,414 |
| Transition freeboard | 0.899 | 360 | 48.8 | 2 | 15,783 | 31,565 | 0.11 | 3,472 |
| Transition submerged | 0.805 | 360 | 48.8 | 14 | 15,783 | 197,852 | 0.11 | 21,764 |
| TOTAL | | | | | 62,081 | 571,680 | | 63,669 |

TABLE 5

Example Semisubmersible Trimaran Outrigger Pontoons

| Block | Shape factor | Length (m) | Width (m) | Depth (m) | Area ($m^2$) | Volume ($m^3$) | LS Coeff. | LS Wt (mt) |
|---|---|---|---|---|---|---|---|---|
| PF column above OWL | 0.675 | 45.7 | 18.1 | 25 | 559 | 13,964 | 0.12 | 1,676 |
| SF column above OWL | 0.675 | 45.7 | 18.1 | 25 | 559 | 13,964 | 0.12 | 1,676 |
| PA column above OWL | 0.675 | 45.7 | 18.1 | 25 | 559 | 13,964 | 0.12 | 1,676 |
| SA column above OWL | 0.675 | 45.7 | 18.1 | 25 | 559 | 13,964 | 0.12 | 1,676 |
| PF column pontoon to OWL | 0.675 | 45.7 | 18.1 | 11 | 559 | 6,144 | 0.12 | 737 |
| SF column pontoon to OWL | 0.675 | 45.7 | 18.1 | 11 | 559 | 6,144 | 0.12 | 737 |
| PA column pontoon to OWL | 0.675 | 45.7 | 18.1 | 11 | 559 | 6,144 | 0.12 | 737 |
| SA column pontoon to OWL | 0.675 | 45.7 | 18.1 | 11 | 559 | 6,144 | 0.12 | 737 |
| P pontoon transition freeboard | 0.92 | 213.3 | 21.9 | 2 | 4,307 | 8,615 | 0.15 | 1,292 |

TABLE 5-continued

Example Semisubmersible Trimaran Outrigger Pontoons

| Block | Shape factor | Length (m) | Width (m) | Depth (m) | Area ($m^2$) | Volume ($m^3$) | LS Coeff. | LS Wt (mt) |
|---|---|---|---|---|---|---|---|---|
| S pontoon transition freeboard | 0.92 | 213.3 | 21.9 | 2 | 4,307 | 8,615 | 0.15 | 1,292 |
| P pontoon | 0.855 | 213.3 | 21.9 | 14 | 4,003 | 56,042 | 0.15 | 8,406 |
| S pontoon | 0.855 | 213.3 | 21.9 | 14 | 4,003 | 56,042 | 0.15 | 8,406 |
| TOTAL | | | | | 21,092 | 209,746 | | 29,048 |

TABLE 6

Example Semisubmersible Trimaran Representative Deadweights

| | | At Transit Draft | | At Operating Draft | |
|---|---|---|---|---|---|
| Item | Unit Wt | Qty. | Weight | Qty. | Weight |
| Bulk Fluids | ($mt/m^3$) | ($m^3$) | (mt) | ($m^3$) | (mt) |
| Potable Water | 1 | 22,000 | 22,000 | 22,000 | 22,000 |
| Fuel | 0.8 | 25,000 | 20,000 | 30,000 | 24,000 |
| Diesel for Vehicles | 0.75 | 20,000 | 15,000 | 20,000 | 15,000 |
| Aviation fuel | 0.65 | 22,000 | 14,300 | 22,000 | 14,300 |
| Lube/Hydraulic Oil | 0.93 | 1,000 | 930 | 1,000 | 930 |
| Ballast | 1.025 | 27,598 | 28,288 | 119,339 | 122,322 |
| Cargo | (mt) | (each) | (mt) | (each) | (mt) |
| Containers | 27.5 | 575 | 15,812.5 | 2,725 | 74,937.5 |
| Tanks, heavy vehicles | 70 | 0 | 0 | 150 | 10,500 |
| Trucks/vehicles | 12 | 0 | 0 | 570 | 6,840 |
| Aircraft | 6 | 0 | 0 | 200 | 1,200 |
| Crew and provisions | 0.5 | 1,000 | 500 | 10,000 | 5,000 |
| Supplies, misc. | | | 5,000 | | 20,000 |
| Total Deadweight | (mt) | 121,831 | | 317,029.5 | |
| Allowable Deadweight | | 106,851 | | 306,785 | |
| Ballast Required | | −14,979 | | −10,244 | |
| Container Space Required | | 4,700 $m^2$ | | 22,276 $m^2$ | |
| Container Space Available | | 22,406 $m^2$ | | 22,406 $m^2$ | |
| Cargo Fluids on Board | | 23.8 million gallons | | 25.1 million gallons | |
| Fluid Space Required | | 90,093 $m^3$ | | 95,013 $m^3$ | |
| Fluid Space Available | | 223,167$m^3$ | | 223,167 $m^3$ | |
| Number of Vehicles | | 0 | | 720 | |
| Vehicle Capacity | | 724 | | 724 | |

The invention is described above with reference to non-limiting examples provided for illustrative and explanatory purposes only. Various modifications and changes will become apparent to the skilled artisan in view thereof. It is intended that all such changes and modifications are within the scope and spirit of the appended claims and embraced thereby.

What is claimed is:

1. A semisubmersible trimaran comprising an upper deck structure supported on a longitudinal center hull, a pair of column-stabilized, longitudinal outrigger pontoons laterally spaced from the center hull on opposite sides thereof and a marine docking facility on at least one of the pontoons or the center hull.

2. The semisubmersible trimaran of claim 1 wherein the upper deck structure has a thickness of at least about 20 meters.

3. The semisubmersible trimaran of claim 1 further comprising a superstructure on an upper surface of the deck structure.

4. The semisubmersible trimaran of claim 3, further comprising a runway on the upper surface of the deck structure.

5. An afloat seabase, comprising an end-to-end assemblage of a plurality of the semisubmersible trimarans of claim 1.

6. The semisubmersible trimaran of claim 1 further comprising a ballast control system to adjust a draft of the trimaran between a relatively shallow transit draft and a relatively deep operating draft, and to regulate trim and list of the trimaran.

7. The semisubmersible trimaran of claim 6 wherein the operating draft is from about 180 to 220 percent of the transit draft.

8. The semisubmersible trimaran of claim 6 wherein the center bull comprises a full waterplane area of the hull at the transit draft and a reduced waterplane area of the hull at the operating draft.

9. The semisubmersible trimaran of claim 8 wherein the reduced waterplane area of the center hull is from 40 to 65 percent of the full waterplane area of the hull.

10. The semisubmersible trimaran of claim 6 wherein a full waterplane area of the outrigger pontoons at the transit draft is from 3 to 5 times a reduced waterplane area of the outrigger support columns at operating draft.

11. The semisubmersible trimaran of claim 6 wherein a total reduced waterplane area of the trimaran at operating draft is from 35 to 60 percent of a total full waterplane area of the trimaran at transit draft.

12. The semisubmersible trimaran of claim 11 wherein the outrigger support columns include columns spaced fore and aft extending upright from the outrigger pontoons to the upper deck structure.

13. The semisubmersible trimaran of claim 1 further comprising a transit propulsion drive on the center hull selected from propeller screws, thruster pods, and combinations thereof.

14. The semisubmersible trimaran of claim 1 further comprising a plurality of dynamic positioning drives on the pontoons.

15. The semisubmersible trimaran of claim 14 wherein the dynamic positioning drives are retractable for transit streamlining.

16. The semisubmersible trimaran of claim 1 comprising a marine berthing facility adjacent at least one of the pontoons.

17. A semisubmersible trimaran comprising an upper deck structure supported on a longitudinal center hull, a pair of column-stabilized, longitudinal outrigger pontoons laterally spaced from the center hull on opposite sides thereof and a marine berthing facility adjacent at least one of the pontoons.

18. The semisubmersible trimaran of claim 1 wherein an operating displacement is from about 120 to 200 percent of a transit displacement, and an available operating deadweight is at least twice an available transit deadweight.

19. The semisubmersible trimaran of claim 1 wherein the upper deck structure has a length from about 1.5 to 2.1 times a width thereof.

20. The semisubmersible trimaran of claim 1 wherein a length of the center hull is from about 150 to 200 percent of a length of the outrigger pontoons.

21. A semisubmersible trimaran, comprising:

(a) an upper deck structure supported on a longitudinal center hull and first and a second outrigger pontoons, wherein the outrigger pontoons each depend from a plurality of upright columns and are laterally spaced from the center hull on opposite sides thereof;

(b) a ballast control system to adjust a draft and to regulate trim and list of the trimaran;

(c) full and reduced waterplane areas at transit and operating drafts, respectively, of the center hull and the outrigger pontoons and columns, wherein the reduced waterplane area of the center hull comprises from 40 to 65 percent of the full waterplane area of the hull, and the full waterplane area of the outrigger pontoons comprises from 3 to 5 times the reduced waterplane area of the columns.

22. A semisubmersible trimaran, comprising:

(a) an upper deck structure supported on a longitudinal center hull;

(b) a first longitudinal outrigger pontoon and a second longitudinal outrigger pontoon, said first and second outrigger pontoons laterally spaced from the center hull on opposite sides thereof, wherein the outrigger pontoons are stabilized by a plurality of columns connected to the deck structure;

(c) a transit propulsion drive on the center hull selected from propeller screws, thruster pods, and combinations thereof;

(d) a plurality of dynamic positioning drives on the pontoons; and (e) a marine docking facility on at least one of the pontoons or the center hull.

23. The semisubmersible trimaran of claim 22, further comprising a ballast control system to adjust a draft of the trimaran between a relatively shallow transit draft with a full waterplane area and a relatively deep operating draft with a reduced waterplane area comprising from 35 to 60 percent of the full waterplane area.

24. A semisubmersible trimaran, comprising:

(a) an upper deck structure supported on a longitudinal center hull;

(b) a pair of column-stabilized, longitudinal outrigger pontoons laterally spaced from the center hull on opposite sides thereof;

(c) a ballast control system to adjust a draft of the trimaran between a relatively shallow transit draft with a full waterplane area and a relatively deep operating draft with a reduced waterplane area comprising from 35 to 60 percent of the full waterplane area; and (d) a marine docking facility below the upper deck structure on the center hull or one of the outrigger pontoons accessible at the operating draft.

25. A semisubmersible trimaran, comprising:

(a) a central hull with a bow, a stem, and side walls providing a series of buoyancy compartments;

(b) a deck structure supported on the central hull, said deck structure having fore and aft portions, port and starboard wings, and top and bottom surfaces defining a storage space therebetween;

(c) first and second pontoons each connected to the deck structure by a plurality of columns, said first pontoon laterally positioned beneath the port wing, said second pontoon laterally positioned beneath the starboard wing;

(d) liquid storage compartments in the central hull and pontoons;

(c) a ballast control system comprising ballast tanks in the hull and pontoons to control a draft of the trimaran between a relatively shallow transit draft and a relatively deep operating draft; and (f) a marine docking facility on at least one of the pontoons or the center hull.

26. The semisubmersible trimaran of claim 25, comprising a full waterplane area at the transit draft and a reduced waterplane area at the operating draft comprising from 35 to 60 percent of the full waterplane area.

27. The semisubmersible trimaran of claim 25, further comprising a runway to launch and land fixed wing aircraft on the upper deck structure.

28. An afloat seabase comprising a plurality of semisubmersible trimarans according to claim 27 connected end-to-end to align the runways.

* * * * *